US007513450B2

(12) United States Patent
Young et al.

(10) Patent No.: US 7,513,450 B2
(45) Date of Patent: Apr. 7, 2009

(54) CUTTER ASSEMBLY WITH S-SHAPED BLADE

(75) Inventors: Harlow Young, Kennewick, WA (US); John Julian, Richland, WA (US)

(73) Assignee: Centlgra Foods, Inc., Omaha, NE (US)

( * ) Notice: Subject to any disclaimer, the term of this patent is extended or adjusted under 35 U.S.C. 154(b) by 0 days.

(21) Appl. No.: 11/378,924

(22) Filed: Mar. 17, 2006

(65) Prior Publication Data

US 2007/0215736 A1 Sep. 20, 2007

(51) Int. Cl.
*B02C 18/16* (2006.01)

(52) U.S. Cl. ..... 241/292.1; 241/282.1

(58) Field of Classification Search ..... 241/277, 241/282.1, 292.1, 282.2; 83/582, 588, 686; 30/932, 114, 124
See application file for complete search history.

(56) References Cited

U.S. PATENT DOCUMENTS 48,316 A * 6/1865 Sloan ..... 241/258
1,512,484 A * 10/1924 Porter ..... 241/277
2,794,628 A * 6/1957 Fessenden ..... 416/234
2,977,901 A * 4/1961 Deary, Sr. et al. ..... 425/385
3,109,470 A 11/1963 Urschel et al.
3,132,423 A * 5/1964 De Lano ..... 30/114
6,799,495 B2 10/2004 Jensen

FOREIGN PATENT DOCUMENTS

EP 0873828 8/2003

* cited by examiner

*Primary Examiner*—Faye Francis
(74) *Attorney, Agent, or Firm*—Merchant & Gould, P.C.

(57) ABSTRACT

The present invention is directed to a cutting apparatus, which includes an s-shaped blade, for cutting a foodstuff to form a concave, tapered wedge product. The cutting apparatus includes a cylindrical housing member, a ring member, which receives and holds the s-shaped blade, and a base member affixed to the cylindrical housing member. The cylindrical housing receives at least one ring member, typically several. The several ring members, each receiving and holding an s-shaped blade, are stacked together. One or more ring members in the stack can be rotated in order to adjust the angles between the blades. By adjusting the angles between the blades, the size and dimensions of the cut foodstuff can be modified. Typically, the apparatus will be used as part of a high speed processing line.

19 Claims, 13 Drawing Sheets

CUTTER ASSEMBLY WITH S-SHAPED BLADE

FIELD OF INVENTION

The present invention is directed to a cutter assembly that holds at least one s-shaped blade for cutting a foodstuff into concave, tapered wedge-shaped segments. Typically, the cutter assembly will be used as part of a high speed processing line to produce a tapered wedge-shaped potato product.

BACKGROUND

An increasing amount of food products are processed before arriving on a consumer's plate. A variety of fruits and vegetables, for example, are cut or shaped and then frozen or otherwise preserved for later use. In order to meet the demand for processed food products and efficiently produce large quantities of such products, the food industry utilizes various apparatuses that rapidly process large amounts of foodstuff. For example, apparatuses for cutting and shaping large quantities foodstuff are well known in the art and typically comprise a stationary array of cutting knives with a means to propel the food product through the knife array. The food product may be propelled through the knife array by entering it in a fluid stream. In the alternative, the food product may be propelled by mechanical or pneumatic means or by means of a hydraulic plunger.

A typical hydraulic food cutting apparatus in use today has a receiving tank filled with a hydraulic carrier fluid, typically water. Foodstuff is placed into the tank and suspended in the carrier fluid. The suspended food product is pumped from the tank into a segment of tube. The tube aligns the suspended food product with the cutter blade assembly, which typically includes a plurality of knife blades mounted parallel to each other. If the food product is to be cut into slices, only a single such array need be utilized, however, if the food product is to be cut into elongated, slender pieces, such as French fries, or wedges, two such arrays are utilized with the knives in one array extending generally perpendicular to the knives in the other array.

The cutting apparatuses of the prior art utilize straight knife blades. For example, the use of a plurality of straight knife blades stacked perpendicular to one another in a cutting apparatus in order to produce wedge-shaped pieces of foodstuff is known.

There is a need for a cutting apparatus for producing large amounts of tapered or concave wedges of foodstuff. The concave surface of a tapered, concave wedge of foodstuff holds an increased amount of topping or garnish, as compared to the wedges of the prior art, which have planar surfaces.

SUMMARY OF THE INVENTION

The invention pertains to an s-shaped blade that is used in a cutter assembly whereby the assembly receives a foodstuff and cuts it into concave, tapered, wedge-shaped segments. Typically, the cutter assembly receives a potato and cuts it into a tapered wedge-shaped potato product.

The s-shaped cutter blade is a non-planar s-shaped body member having opposed faces, opposed edges, and opposed ends, whereby one edge can be sharpened for cutting. Regardless, one edge will contact the foodstuff to cut it into pieces, so that the edge can be of varying thickness or sharpness so long as the potato is cut. As such, the edge can be sharp or blunt. Alternatively, the s-shaped blade may include at least one ridge on one or more of its faces. Importantly, the blade is designed and dimensioned to cut a potato to form the above-described shape.

The cutter assembly houses the s-shaped blade. The assembly may be of a variety of constructions so long as the blade or multiple blades are held in a position to cut the foodstuff in such a way as to produce a desired finished product. The cutter assembly can hold the blades in a number of different configurations to produce finished products having a variety of dimensions. The cutter assembly includes a housing member, which holds the blades, and a base affixed to the housing member. The base is provided to support and hold the housing as well as the blades in the housing and to mount the cutter assembly into an industrial food processing apparatus. The cutter assembly can thus be removably inserted into a cutting apparatus, whereby the device will receive and cut foodstuff, such as potatoes, as part of an industrial process.

The base can be of any shape, so long as it supports the housing and can be incorporated into a food processing apparatus. The base has an inner wall that has an edge, typically an annular edge, which forms a hole. When the housing is affixed to the base, it rests on the outer cut-away of the base.

The housing can be designed in any number of ways, provided that it fits in a high-speed food processing system. Typically, the housing has a cylindrical construction to form a cup shape and has an inner wall, with an annular edge, and an outer wall. The cylindrical construction, in particular, conforms to the design of some current industrial cutting systems. The housing is also designed and dimensioned to hold one or more blade-holding members, typically ring members.

In general, the blade-holding member can be of any shape, so long as it can be received and held by the housing and it can receive and hold one or more s-shaped blades in position. In particular, the blade-holding member may be a ring member. Such a ring has an inner wall, which has an annular edge that forms a hole, and an outer wall, whereby the s-shaped blade is held transverse the hole. A ring member is typically used with a cylindrical housing member, and the housing typically holds at least one, and more likely between one and ten ring members, each holding one s-shaped blade.

DETAILED DESCRIPTION

The present invention relates to a cutting assembly, including an s-shaped blade, for producing tapered or concave wedges of foodstuff, such as a unique potato product. In particular, the cutting assembly produces a food product, i.e., a potato product, which has a concave surface that holds an increased amount of topping or garnish. The s-shaped blade has a non-planar, s-shaped body and cuts foodstuff to produce uniquely shaped segments of foodstuff. The cutting assembly can be used as part of an industrial process to treat thousands of pounds of foodstuff, such as potatoes, with the cutting device including a member for holding at least one s-shaped blade in position. The device can hold multiple blades in a number of different configurations. The device includes a housing, which can be designed in any number of ways, provided that it fits in an existing or contemplated food processing system, such as a hydraulic food cutting apparatus. More specifically, the housing is designed and dimensioned to hold at least one blade-holding member, which holds a blade and maintains it in position. The apparatus and its various elements are shown in FIGS. 1 through 12 and wedges of foodstuff produced by the apparatus are shown in FIG. 13.

Figure 1:
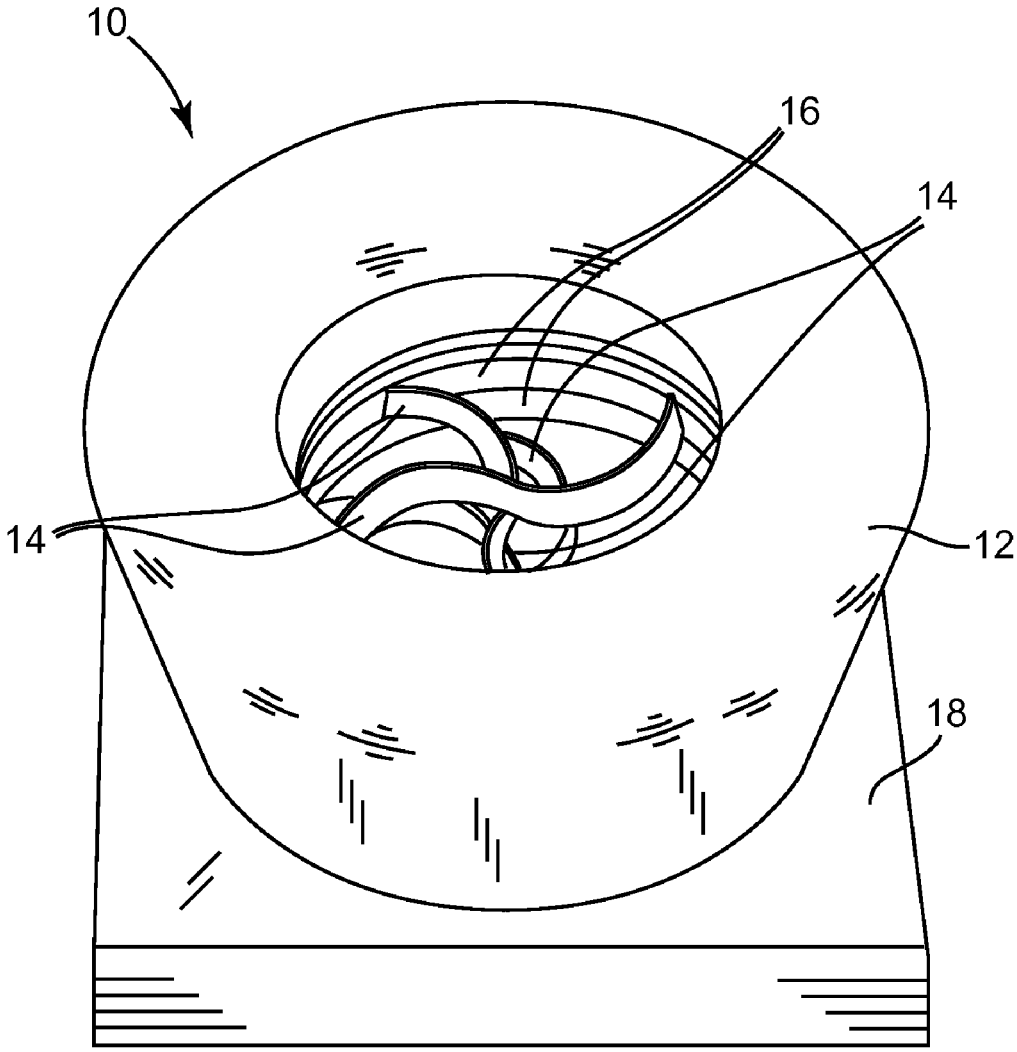
FIG. 1 is a top-perspective view of a cutter assembly, showing a cylindrical housing member that holds four ring members, each holding an s-shaped blade, and a base member.

A cutter assembly 10, shown in FIG. 1, for cutting foodstuff into concave tapered wedges includes at least one s-shaped blade 14 received by a blade-holding member 16, typically an annular ring member. The ring member 16 is held or received by a housing member 12, typically the housing member is of a cylindrical construction. The housing member 12 is designed and dimensioned to receive and hold the ring member. The cutter assembly 10 further includes a base member 18 affixed to the housing member 12. The base is provided for mounting the cutter assembly 10 into a food cutting apparatus, such as a hydraulic food cutting apparatus. Thus, a device 10 is provided that can be removably inserted into a cutting apparatus, whereby the device will receive and cut potatoes, for example, as part of an industrial process.

Figure 2:
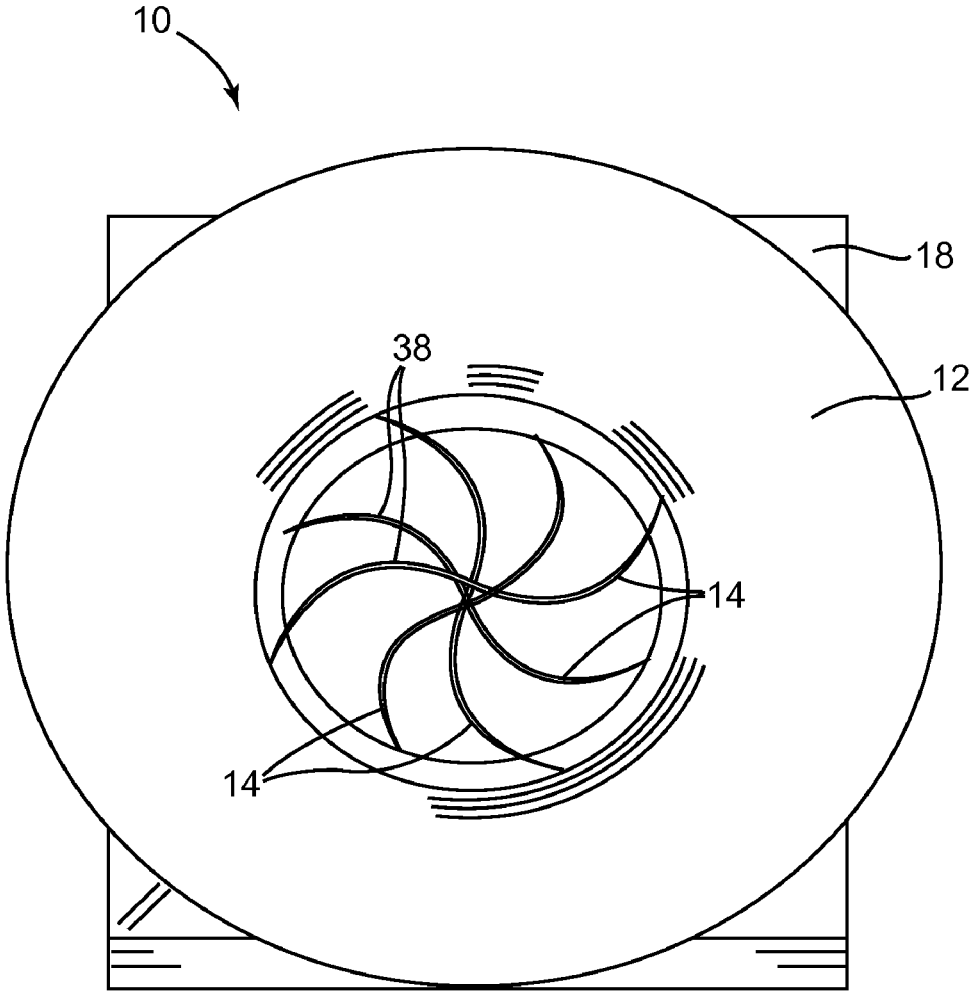
FIG. 2 is a top view of a cutter assembly, showing the blunt edges of the blades.
Figure 3:
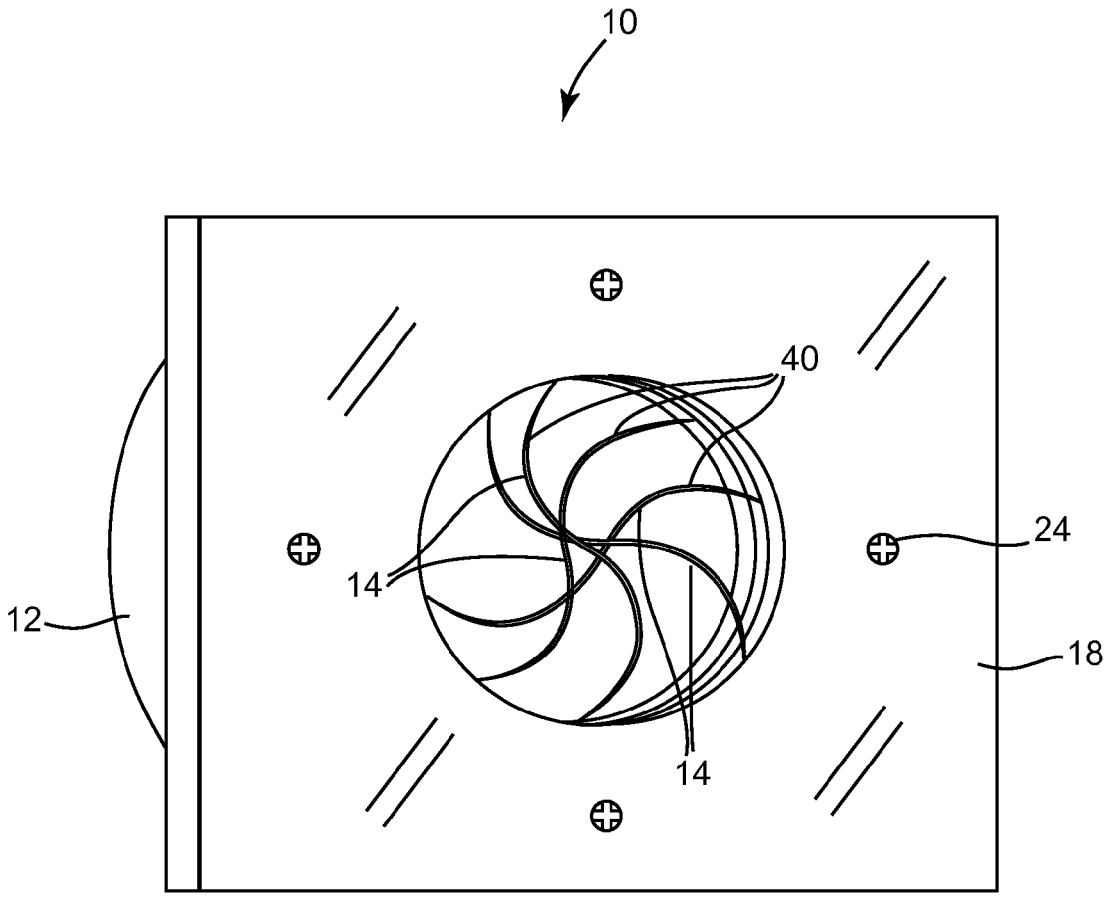
FIG. 3 is a bottom view of a cutter assembly, showing the knife edges of the blades.

When the cutter device 10 is inserted into a cutting apparatus, the knife edges 40 of the blades are oriented toward the uncut foodstuff or foodstuff that requires additional cutting. In general, in a cutting assembly with multiple blades, the knife edges of the multiple blades 40 are all oriented in the same direction. A cutter assembly is shown in FIG. 3, with a view of the knife edges 40. FIG. 2 shows the opposing view of the cutter assembly, namely a view of the blunt edges 38.

Figure 4:
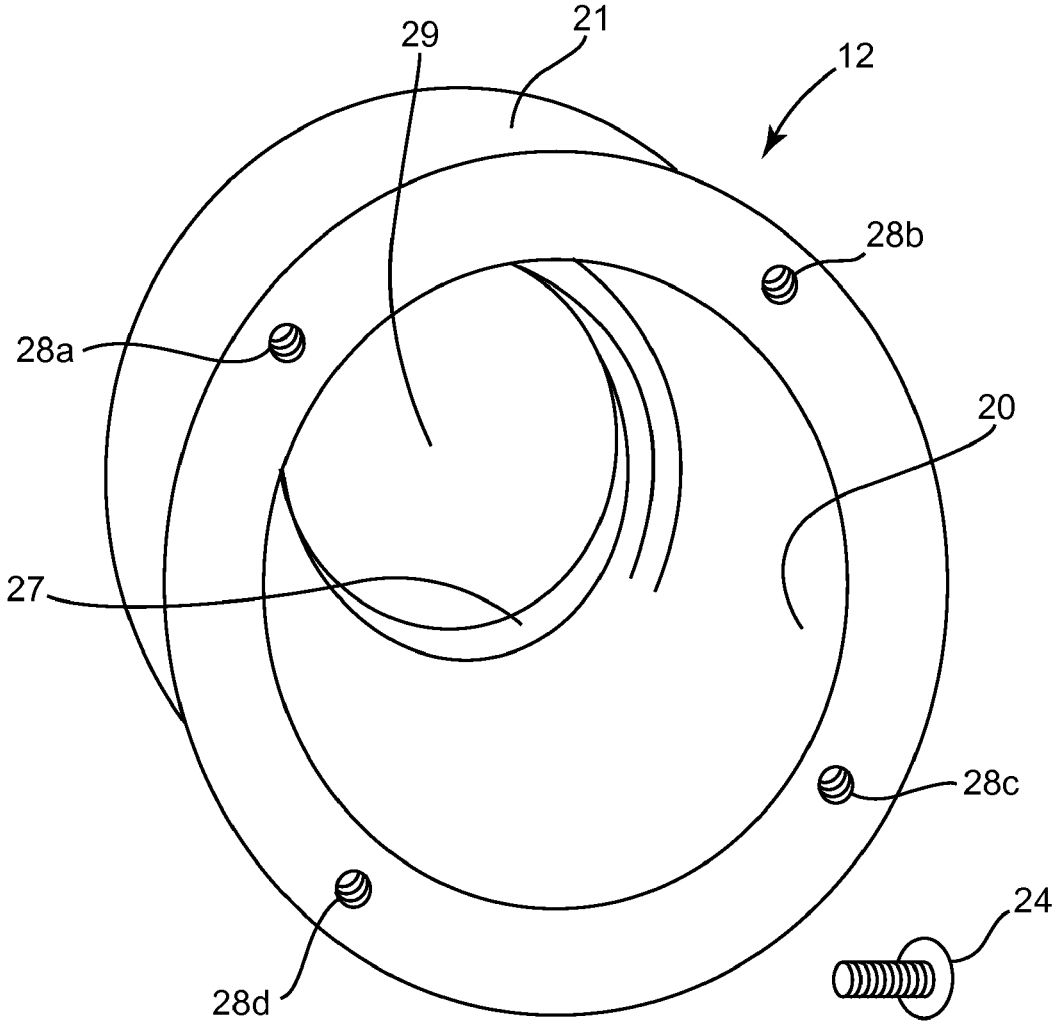
FIG. 4 is a view of a cylindrical housing member.
Figure 5:
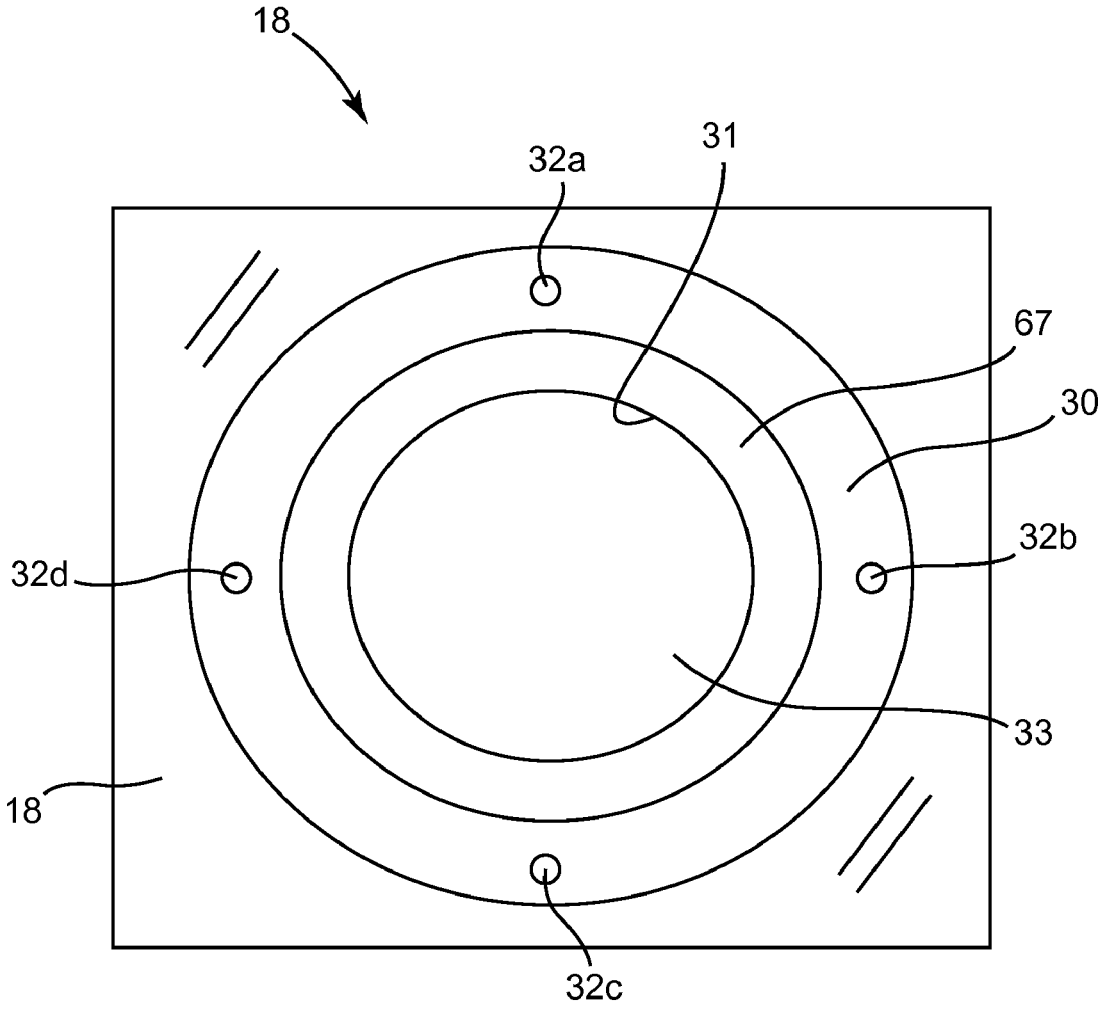
FIG. 5 is a view of a base member.

The base member 18, shown at FIG. 5, can be formed from a variety of materials. For example, the base member can be made from a food grade plastic. Suitable plastics include acetyl plastic, ultra high molecular weight plastic, and high-density plastic. Conversely, the base member can be made from metal, including various types of stainless steel. The base member 18 has an inner wall 31 that has an edge, typically an annular edge, which forms a hole 33. The base 18 includes a plurality of holes 32*a*, 32*b*, 32*c*, 32*d* for receiving one or more fastening members 24, shown at FIG. 3, such as screws, to hold the base in contact with the housing. The fastening members 24 are inserted through the holes of the base 32*a*, 32*b*, 32*c*, 32*d* and threaded into holes 28*a*, 28*b*, 28*c*, 28*d*, shown at FIG. 4, in the cylindrical housing member 12, thereby affixing the base 18 to the cylindrical housing member 12 such that the housing rests on the outer cut-away 30 of the base. Numerous different constructions of the base may be used, provided the base can be incorporated into an industrial cutting process. As such, the base 18 can be of any shape so long as it supports and holds the housing, especially the blades in the housing, in position.

The housing 12, shown in FIG. 4, can be formed from a variety of materials and in a variety of shapes. Because of the design of current cutting systems, the housing 12 typically has a cylindrical shape. Again, food grade plastics, such as acetyl plastic, ultra high molecular weight plastic, and high-density plastic can be used. Conversely, the housing member 12 can be made from metal such as stainless steel or any other rigid material that can be used in an industrial process.

Figure 10:
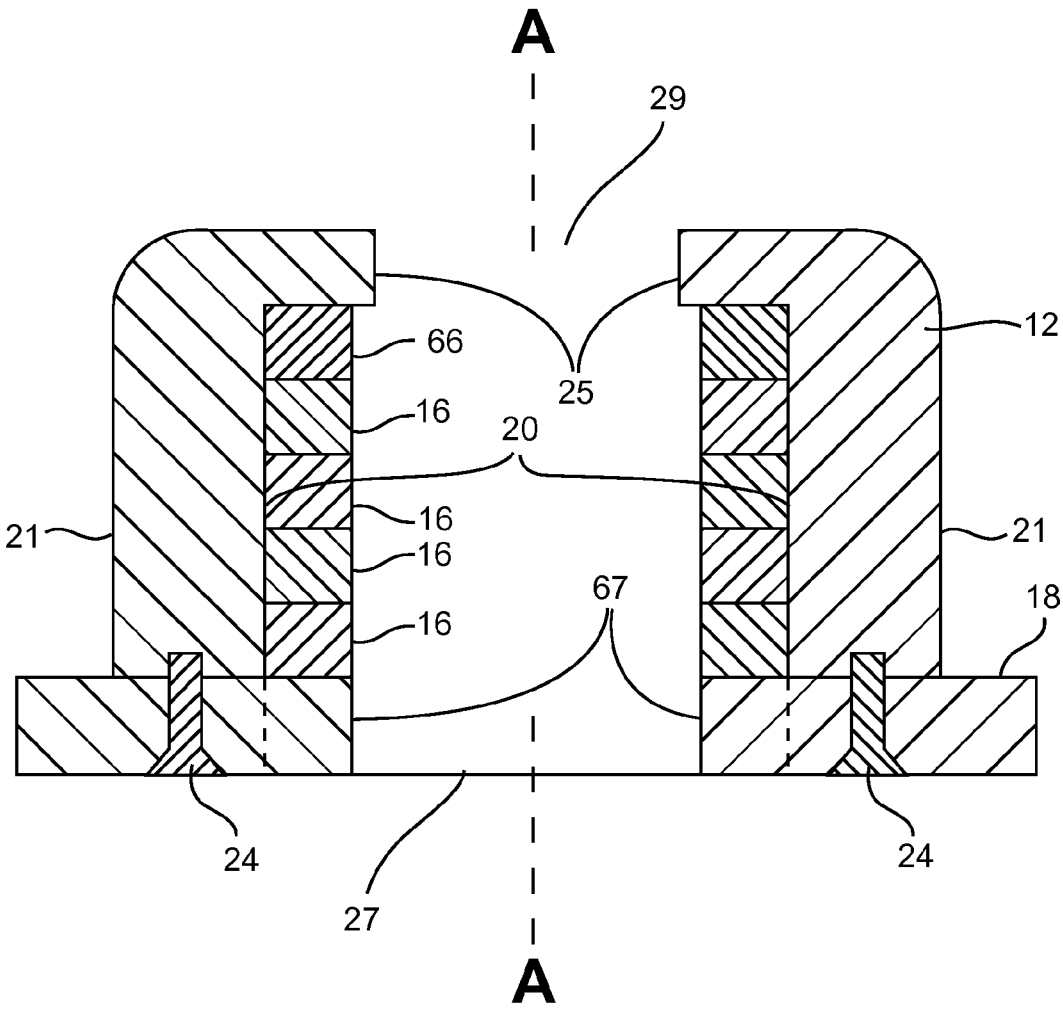
FIG. 10 is a cross-sectional view taken along line A-A of a cutter assembly, showing a cylindrical housing member that holds four ring members and an end retainer member, a base, and several fastening members for attaching the base to the cylindrical housing.
Figure 11:
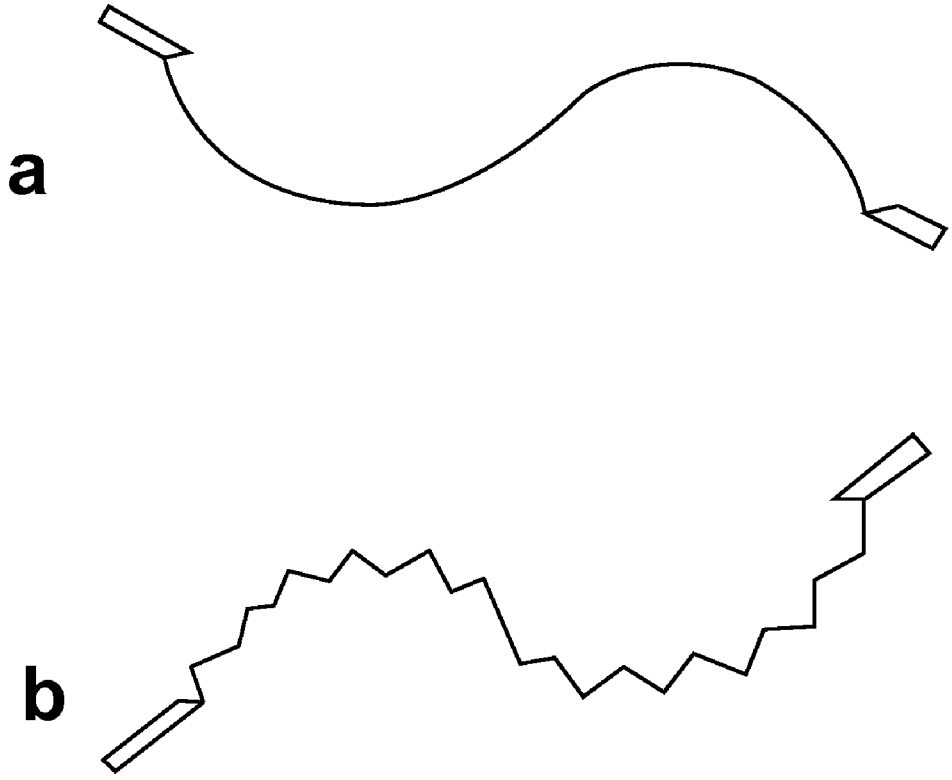
FIG. 11*a* is an enlarged top view of an s-shaped blade and FIG. 11*b* is an enlarged top view of an s-shaped blade with ridges on its faces.

Typically, the housing member 12 has a cylindrical construction to form a cup shape and has an inner wall 20 and an outer wall 21, shown in FIGS. 4 and 10. One end of cup 12 is open 27, with the opening intended to allow placement of a blade-holding member 16. The cup-shaped cylindrical housing member 12 has a base that extends inward to form an inner lip 25, shown in FIG. 10, whereby a blade-holding member rests on the lip. The lip has an edge, which forms a hole 29. The blade-holding member may directly contact the lip 25, or, alternatively, the blade-holding member may contact an end retainer member 66, which contacts the lip 25, as shown in FIG. 10. The cup shape is used in order to conform to available industrial processes. That being said, other designs may be used, provided the blades are held in position and the device 10 can be used with an industrial food processing system.

Figure 6:
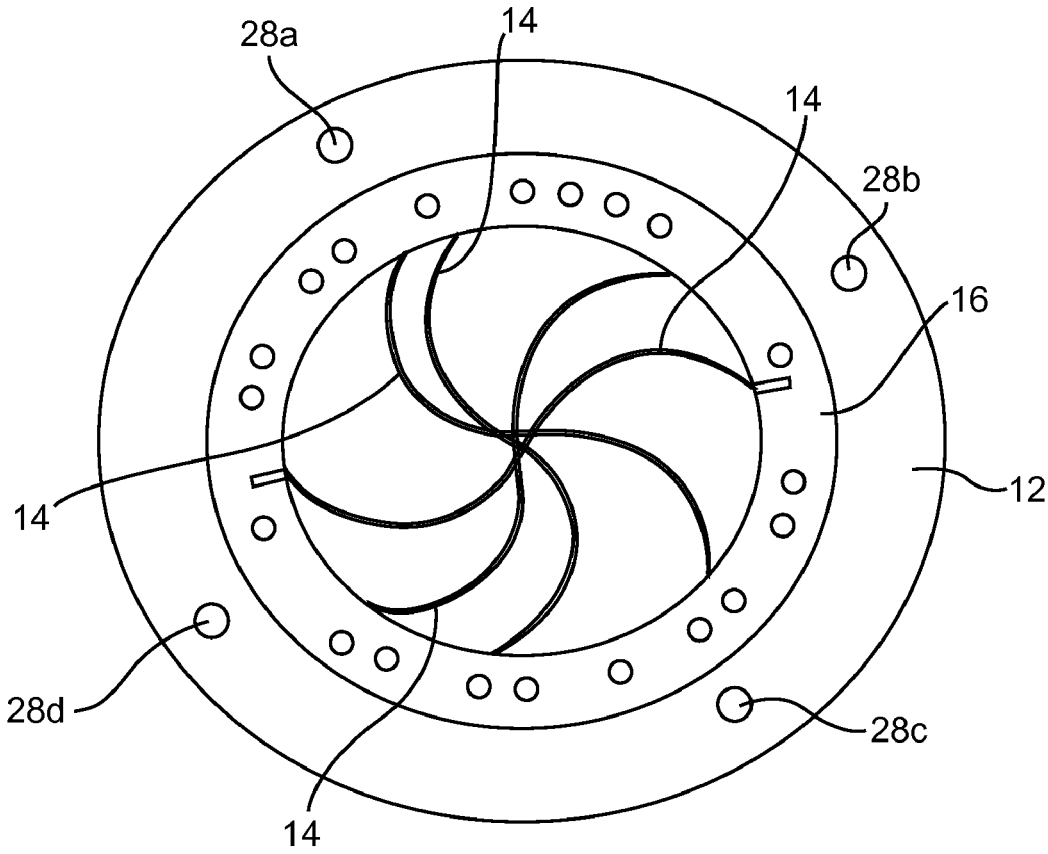
FIG. 6 is a top view of a cylindrical housing member that holds four s-shaped blades.
Figure 7:
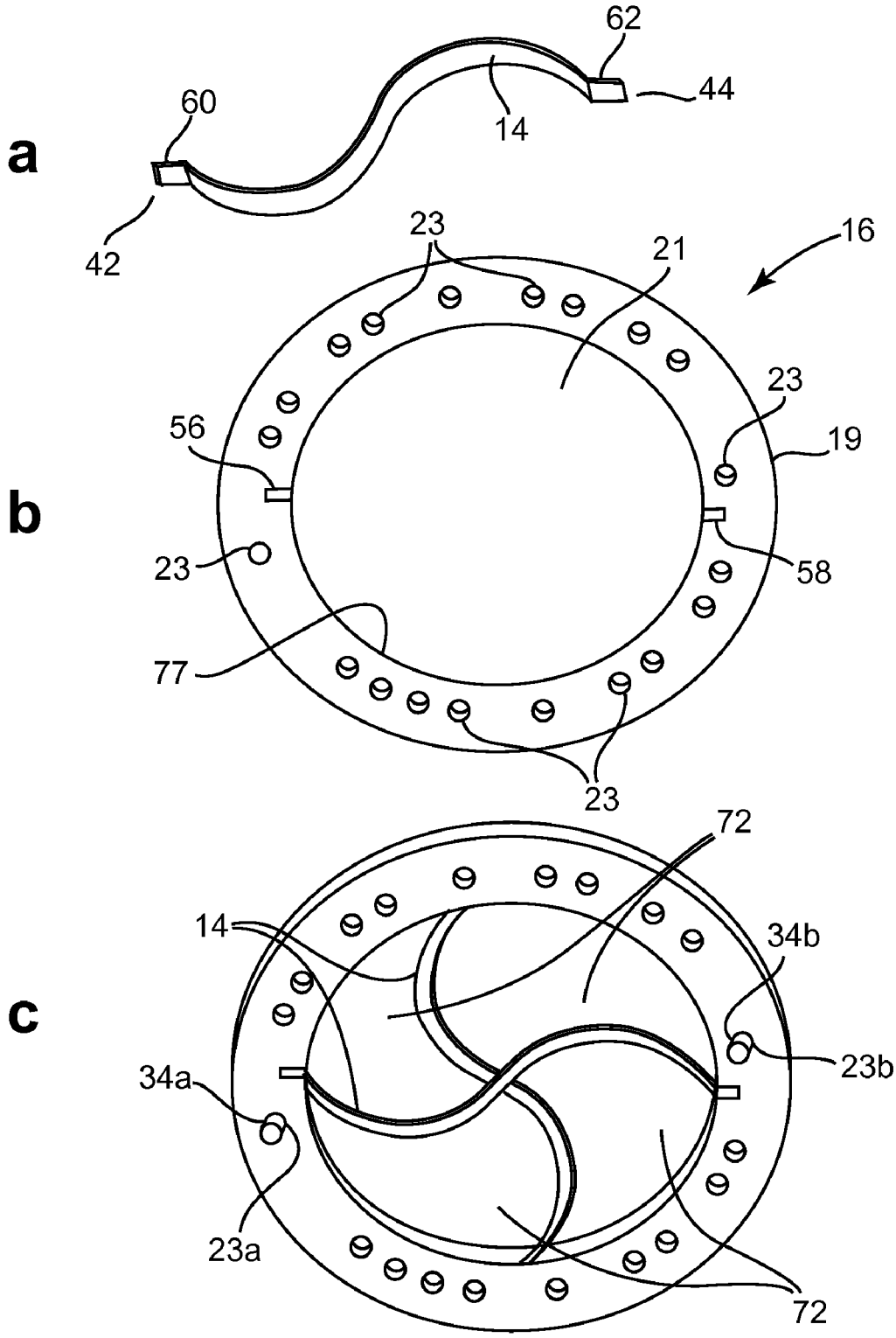
FIG. 7*a* is a view of a blade.
FIG. 7*b* is a view of a ring member.
FIG. 7*c* is a view of a stack of two ring members, each holding an s-shaped blade.
Figure 9:
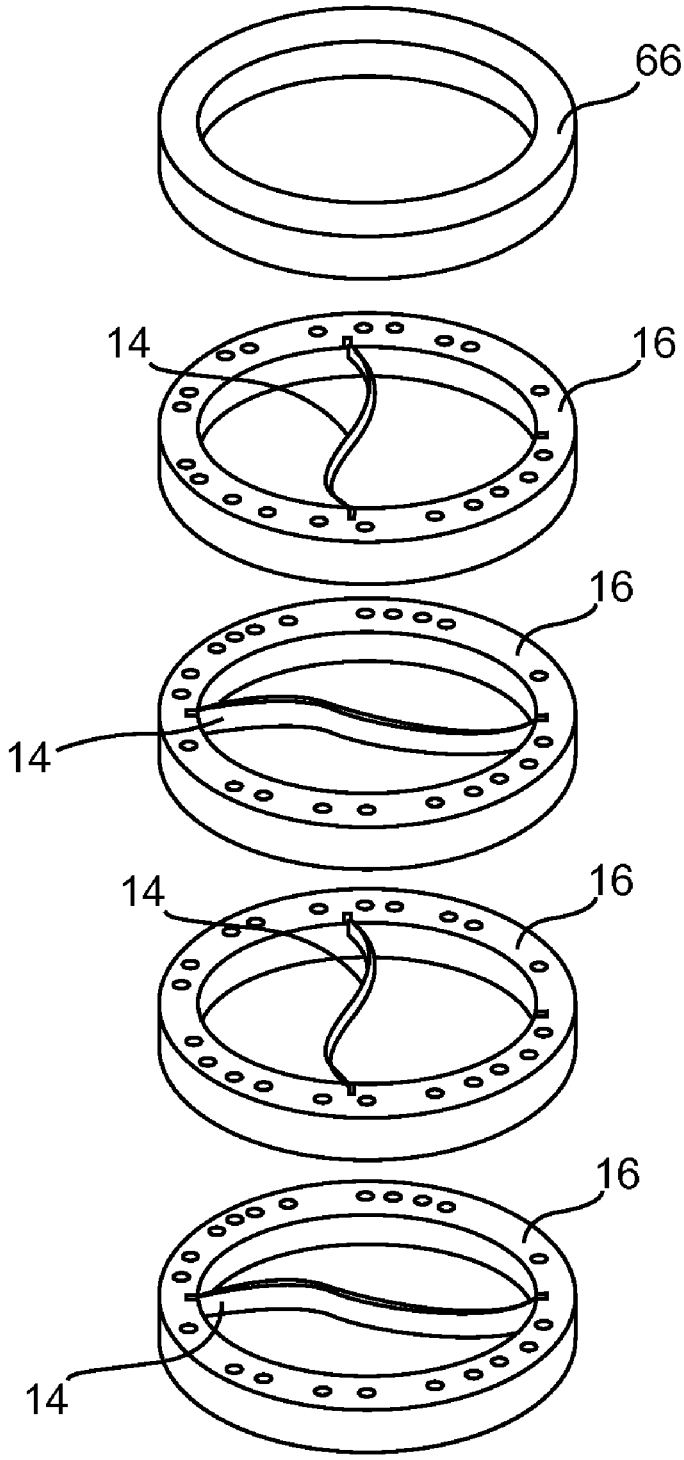
FIG. 9 is an enlarged view of four ring members, each holding an s-shaped blade, and an end retainer member.

The housing member 12 holds at least one blade-holding member 16, which holds and positions a blade 14, as shown in FIG. 6. The member 16 will conform to the shape of the housing member 12, which, again, is shaped and designed for use in an industrial process, meaning a variety of shapes and sizes can be used. The member 16 is typically a ring designed and dimensioned to receive at least one s-shaped blade 14, as shown in FIG. 9. A ring member 16 is generally used with a cylindrical housing member. More specifically, the inner wall 20 of the cylindrical housing member 12 receives and holds at least one annular ring member 16, as shown in FIG. 10. On one end of a cutter assembly, the annular ring member rests on the lip 25 of the cylindrical housing member, contacting the end retainer member 66, which is also typically a ring. The end retainer ring relieves friction between the ring member that it contacts and the housing and it distributes pressure. On the opposing end of the cutter assembly, the annular ring member rests on the base member 18, specifically the inner cut-away 67 of the base member, as shown in FIG. 10. The cylindrical housing member can typically hold between one and ten annular ring members. Generally, the cylindrical housing member receives and holds one to ten and more likely four annular ring members.

The ring member 16, shown in FIG. 7*b*, can be formed from a variety of materials. Typically, the ring member is made from a food grade metal, such as stainless steel, i.e., 300 series stainless steel. The ring member 16 has a hole 21, which is formed by an inner wall 17 that typically has an annular edge, and an outer wall 19. The ring member 16 also has a plurality of perforations 23. Typically, the ring member 16 has between two and twenty perforations 23. The ring member 16 generally has an even number of perforations symmetrically spaced on the member. When several ring members are stacked together, as shown in FIG. 7*c*, at least one pair of symmetrical perforations 23*a*, 23*b* aligns axially to receive a pair of bar members 34*a*, 34*b*. Aligned perforations form a threaded hole, which may receive a bar member. The bar members stabilize the stack of ring members and prevent the members from rotating, when a cutter assembly is in use. When two or more ring members, each member with an integral s-shaped blade, are stacked together, the symmetrically arranged perforations allow for the adjustment of the angles 72 between the blades by rotating one or more of the ring members in the stack. In this context, the angle between the blades refers to the rotation (of the rings) required to superimpose either of two blades on the other. Adjusting the angles between blades alters the dimensions of the foodstuff segments that are produced by the cutting assembly. The perforations in a ring member may be arranged or spaced in any of a variety of ways, such that when one or more ring members are stacked together, the angles between blades are adjustable by rotating one or more of the members. In general, any of a variety of constructions may be used such that the angles between blades are adjustable without having to move the blades themselves, thereby decreasing the risk of injury from the blades.

Each ring member also has at least two slots, 56 and 58, as shown in FIG. 7*b*, designed and dimensioned to receive the ends 42, 44 of an s-shaped blade 14, as shown in FIG. 7*a*. More specifically, each slot is designed to receive a substantially planar foot 60, 62 disposed at opposite ends 42, 44 of the s-shaped blade. Each pair of slots 56, 58 is positioned on the ring member so as to receive the opposing ends 42, 44 of the s-shaped blade.

The s-shaped blade is removably attached to the ring member 16. Each ring member receives at least one s-shaped blade. Specifically, the blade is received transverse the hole 21 of the ring member, as shown in FIGS. 7*c* and 9. As such, the ring member is intended to hold the s-shaped blade in position, so as to cut a food product. Further, the ring can be of any shape, so long as it can be received by the housing member and can position the blades to cut foodstuff. Moreover, the configuration of the blades in a cutter assembly, particularly the angles between the blades, can be modified, thereby modifying the dimensions of the resultant food product.

Figure 12:
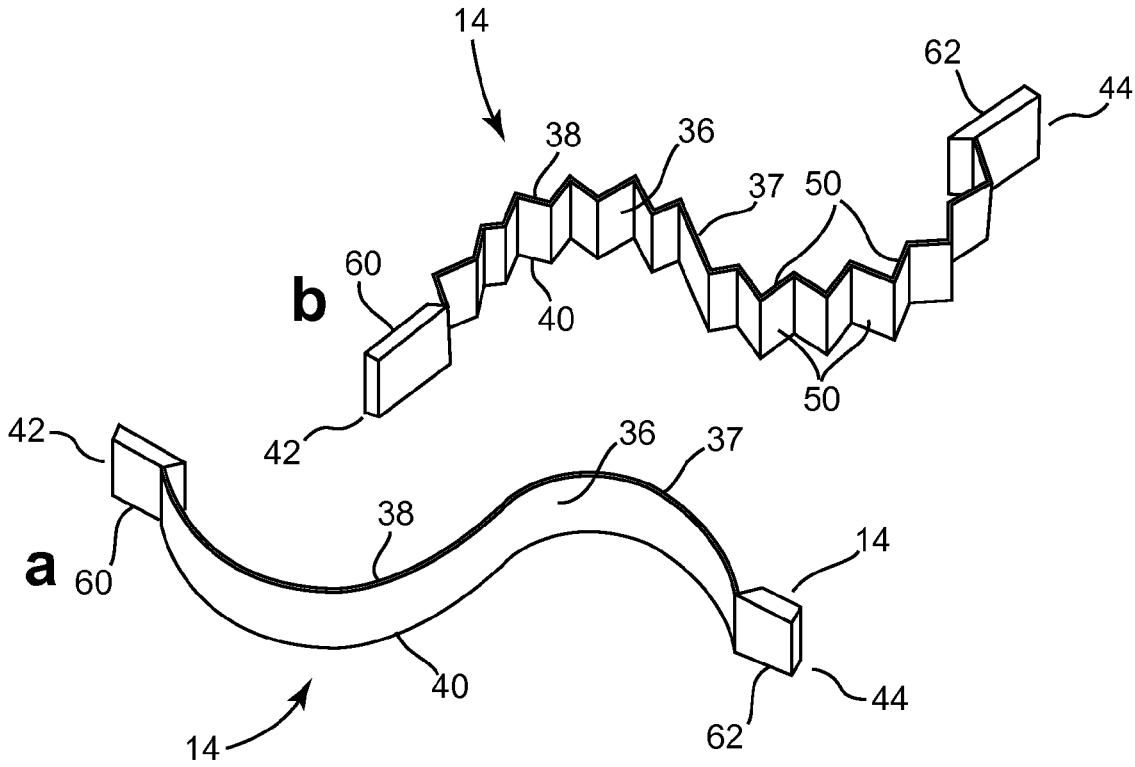
FIG. 12*a* is an enlarged top-perspective view of an s-shaped blade.
FIG. 12*b* is an enlarged top-perspective view of an s-shaped blade with ridges on its faces.
Figure 13:
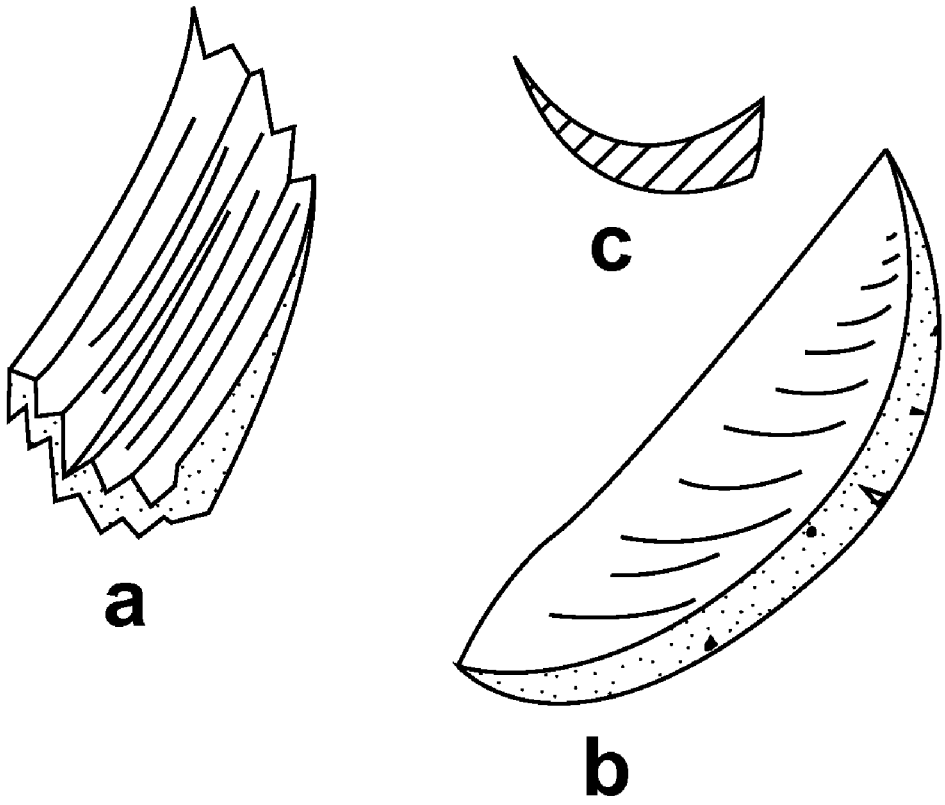
FIG. 13*a* is a view of a concave, tapered wedge of foodstuff with ridges.
FIG. 13*b* is a view of a concave, tapered wedge of foodstuff.
FIG. 13*c* is a cross-sectional view of a concave, tapered wedge of foodstuff.

The non-planar s-shaped blade 14, FIG. 12 *a*, b may be formed from a number of materials, including metal. In particular, the s-shaped blade may be made from stainless steel, such as heat treatable stainless steel. Suitable types of stainless steel include certain varieties of 400 series stainless steel, such as 410 series stainless steel, 420 series stainless steel, and 440 series stainless steel. Other hardened materials for cutting may be used.

The non-planar s-shaped blade 14 has opposed faces 36, 37, opposed edges 38, 40, and opposed ends 42, 44. At least one of the edges 40 is preferably sharpened for cutting. The s-shaped blade comprises a non-planar hardened body member having opposed faces 36, 37, opposed edges 38, 40, and opposed ends 42, 44, whereby one edge is sharpened for cutting 40. The body is formed in a s-shape between the ends. The sharpened edge is directed toward uncut foodstuff, when the cutter assembly is in use. The blade is in the shape of a sigmoid curve. In some alternatives, the s-shaped blade may comprise at least one ridge on one or more of its faces. An s-shaped blade having ridges 50 is shown in FIG. 12*b*. The edges of the s-shaped blade may be crenulated or serrated, as shown in FIG. 12*b* at 38 and 40, to form the ridges 50 on one or more of its faces. The s-shaped blade is received by a ring member. Specifically, the blade is received transverse a hole 21 of the ring member.

Figure 8:
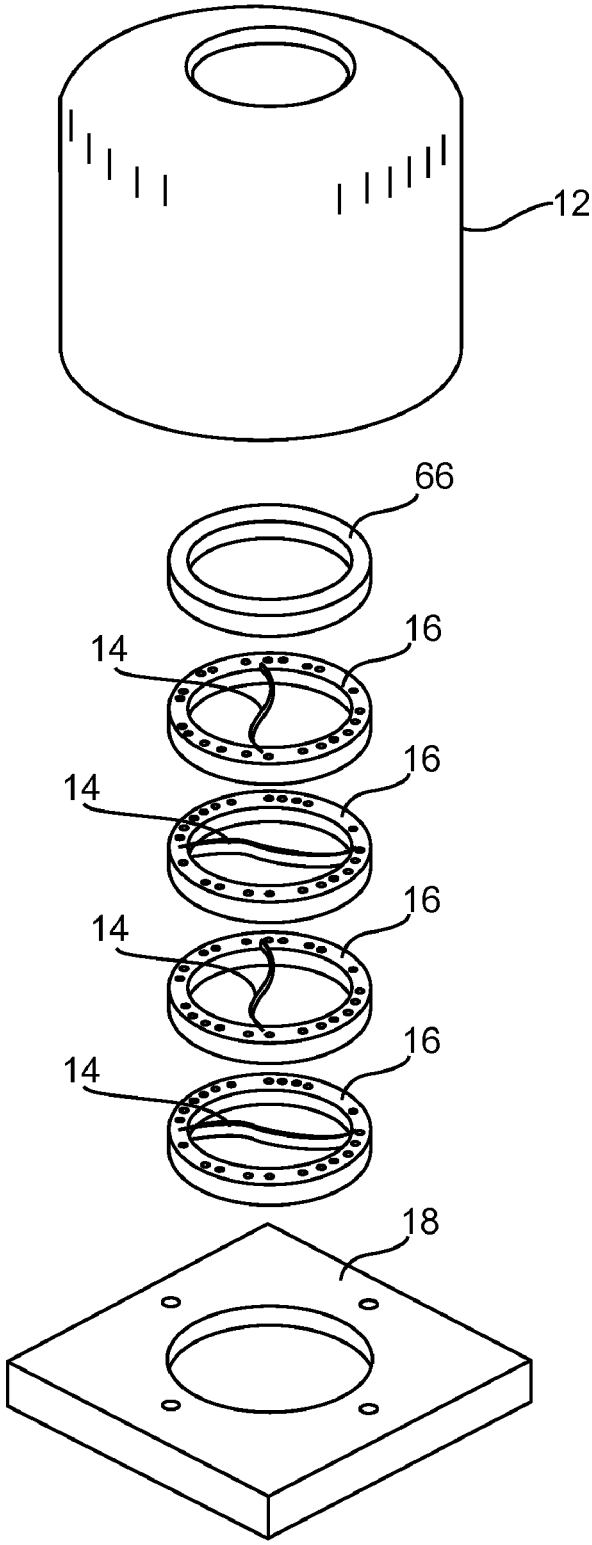
FIG. 8 is an exploded view of a cutter assembly, showing four ring members, each holding an s-shaped blade, an end retainer member, a cylindrical housing member, and a base member.

The use of four ring members, each having one blade and the four members having the same type of blade, with ridges FIG. 12*b*, 14 or without ridges FIG. 12*a*, 14, positioned as shown if FIG. 1, provides suitable angles between blades such that eight, substantially uniformly shaped, concave, tapered, wedge-shaped segments are produced in a single pass. An exploded view of such a cutter assembly is shown in FIG. 8. The cutter assembly generally comprises at least one non-planar s-shaped blade. In particular, the cutter assembly may comprise from one to eight blades. More specifically, the cutter assembly may comprise four blades. Typically, the cutter assembly comprises at least one s-shaped blade received by a ring member and a housing member that receives and holds the ring member. The cutter assembly may comprise from one to eight ring members, each ring receiving at least one s-shaped blade. In some alternatives, the cutter assembly may comprise four ring members, each ring receiving at least one s-shaped blade. More specifically, the cutter assembly may comprise a cylindrical housing member, at least one ring member that has an inner wall and an outer wall, the inner wall having an annular edge that forms a hole, and at least one s-shaped blade received by the ring member and transverse the hole.

The invention also provides a method of cutting foodstuff comprising using the cutting assembly described herein to produce concave, tapered wedges of foodstuff. A concave, tapered wedge of foodstuff comprises a concave surface, which holds an increased amount of topping or garnish, as compared to a wedge comprising planar surfaces. In some aspects, the invention provides a method of cutting foodstuff comprising using the cutting assembly described herein to produce concave, tapered wedges of foodstuff having at least one ridge in the concave surface.

The cut potatoes are formed into a concave, tapered wedge of foodstuff comprising a concave surface which holds an increased amount of topping or garnish, as compared to a wedge comprising planar surfaces. The surface of the concave, tapered wedge of foodstuff is hollowed to form a scoop. The surface of the concave, tapered wedge is rounded inward like the inside of a bowl. The concave, tapered wedge of foodstuff is shown in FIG. 13*b* and FIG. 13*c*, a cross-sectional view. In some aspects, the invention provides a concave, tapered wedge of foodstuff comprising a concave surface having at least one ridge. The concave, tapered wedge with ridges also holds an increased amount of topping or garnish, as compared to a wedge comprising planar surfaces. The concave, tapered wedge with ridges is shown in FIG. 13*a*.

Thus, there has been shown and described an apparatus and a method for producing tapered or concave wedges of foodstuff. A concave, tapered wedge of foodstuff produced by the apparatus or the method has also been shown and described. As various changes could be made in the apparatus, method, or product of the invention without departing from the scope of the invention, it is intended that all matter contained in the above description and in the drawings shall be interpreted as illustrative and not in a limiting sense. Furthermore, while particular examples of using the cutting assembly involve cutting potatoes, the cutting assembly can be used to process any type of food product or foodstuff, which are defined broadly to include any edible substance.

The invention claimed is:

1. A cutter assembly for cutting a concave tapered wedge of a foodstuff comprising:

at least one s-shaped blade having a non-planar, s-shaped body;

at least one blade-holding member that receives the at least one s-shaped blade; and a housing member having an end portion which extends inward to form an inner lip, wherein one of the at least one blade-holding members contacts the inner lip.

2. The cutter assembly of claim 1 wherein the blade-holding member is an annular ring member.

3. The cutter assembly of claim 2 wherein the cutter assembly includes four annular ring members.

4. The cutter assembly of claim 1 wherein the cutter assembly includes one to ten s-shaped blades.

5. The cutter assembly of claim 1 wherein the at least one s-shaped blade has opposed edges in the shape of a sigmoid curve.

6. The cutter assembly of claim 1 wherein the at least one s-shaped blade further comprises at least one ridge on at least one of its faces.

7. The cutter assembly of claim 1 further comprising a base affixed to the housing member.

8. The cutter assembly of claim 1 wherein the housing member is cup shaped.

9. The cutter assembly of claim 1 wherein the blade-holding member directly contacts the inner lip.

10. A cutter assembly for cutting a concave tapered wedge of a foodstuff comprising:

a cylindrical housing member having an end portion which extends inward to form an inner lip having an edge which forms a hole;

at least one ring member having an inner wall and an outer wall, the inner wall having an annular edge that forms a hole, wherein one of the at least one ring members contacts the inner lip of the housing member; and at least one s-shaped blade received by the at least one ring member, wherein the at least one s-shaped blade is transverse in the hole of the at least one ring member.

11. The cutter assembly of claim 10 wherein there are four s-shaped blades.

12. The cutter assembly of claim 10 wherein there are four ring members, wherein each ring member receives at least one s-shaped blade.

13. The cutter assembly of claim 10 wherein the at least one s-shaped blade has opposed edges, the opposed edges in the shape of a sigmoid curve.

14. The cutter assembly of claim 10 wherein the at least one s-shaped blade, having opposed faces, further comprises at least one ridge on at least one of the opposed faces.

15. The cutter assembly of claim 10 further comprising a base member affixed to the cylindrical housing member.

16. The cutter assembly of claim 10 wherein the cylindrical housing member is cup-shaped.

17. The cutter assembly of claim 10 wherein the ring member directly contacts the inner lip of the housing member.

18. A cutter assembly for cutting a foodstuff comprising:

a plurality of s-shaped blades with each of the plurality of s-shaped blades including a non-planar, s-shaped body having a sharpened edge for cutting;

a plurality of blade-holding members, with each of the plurality of blade holding members receiving at least one of the plurality of s-shaped blades; and a housing member defining a bore and having an end portion that extends inward to form an inner lip, wherein the plurality of blade-holding members is disposed in the bore of the housing member with one of the plurality of blade-holding members contacting the inner lip.

19. The cutter assembly of claim 18 wherein the blade-holding member directly contacts the inner lip.

* * * * *

UNITED STATES PATENT AND TRADEMARK OFFICE

CERTIFICATE OF CORRECTION

PATENT NO. : 7,513,450 B2
APPLICATION NO. : 11/378924
DATED : April 7, 2009
INVENTOR(S) : Young et al.

It is certified that error appears in the above-identified patent and that said Letters Patent is hereby corrected as shown below:

Front page, (73) Assignee: "Centlgra Foods, Inc." should read --ConAgra Foods, Inc.--

Signed and Sealed this

Ninth Day of March, 2010

David J. Kappos

David J. Kappos
*Director of the United States Patent and Trademark Office*